US009038250B2

(12) United States Patent
Betz et al.

(10) Patent No.: US 9,038,250 B2
(45) Date of Patent: May 26, 2015

(54) SEAT BELT BUCKLE

(75) Inventors: Hans-Peter Betz, Boebingen (DE); Peter Haas, Eschach (DE); Andrea Schuech, Schwaebisch (DE)

(73) Assignee: TRW Automotive GmbH, Alfdorf (DE)

( * ) Notice: Subject to any disclaimer, the term of this patent is extended or adjusted under 35 U.S.C. 154(b) by 582 days.

(21) Appl. No.: 13/238,029

(22) Filed: Sep. 21, 2011

(65) Prior Publication Data

US 2012/0240367 A1 Sep. 27, 2012

(30) Foreign Application Priority Data

Oct. 15, 2010 (DE) ..... 10 2010 048 597

(51) Int. Cl.
*B60R 22/00* (2006.01)
*A44B 11/25* (2006.01)

(52) U.S. Cl.
CPC ..... *A44B 11/2523* (2013.01); *A44B 11/2546* (2013.01)

(58) Field of Classification Search
CPC ..... A44B 11/2523; A44B 11/2546
USPC ..... 24/614, 615, 616, 633–642
See application file for complete search history.

(56) References Cited

U.S. PATENT DOCUMENTS

| | | | | |
|---|---|---|---|---|
| 4,542,563 | A * | 9/1985 | Befort | 24/641 |
| 6,055,708 | A * | 5/2000 | Ellis et al. | 24/642 |
| 2009/0083955 | A1 * | 4/2009 | Smith | 24/633 |

FOREIGN PATENT DOCUMENTS

| | | | | |
|---|---|---|---|---|
| DE | 102008046651 | A1 * | 3/2010 | A44B 11/25 |
| GB | 2211242 | A * | 6/1989 | E05D 1/02 |

* cited by examiner

*Primary Examiner* — Robert J Sandy
(74) *Attorney, Agent, or Firm* — Tarolli, Sundheim, Covell & Tummino

(57) ABSTRACT

The invention relates to a seat belt buckle (10) comprising a locking mechanism for a plug-in latch and a casing (12) that encloses the locking mechanism and includes an inserting opening (14) for inserting the plug-in latch as well as a release opening (16) in which a release element (20) for releasing the locking mechanism is disposed. There is provided a sealing device (22) for sealing the inserting opening (14), when the plug-in latch is not inserted, and/or the release opening (16).

13 Claims, 1 Drawing Sheet

SEAT BELT BUCKLE

FIELD OF THE INVENTION

The invention relates to a seat belt buckle comprising a locking mechanism for a plug-in latch and a casing that encloses the locking mechanism and includes an inserting opening for inserting the plug-in latch as well as a release opening in which a release element for releasing the locking mechanism is arranged.

BACKGROUND OF THE INVENTION

Seat belt buckles have to work reliably for many years. It may occur especially in the area of the back seats that seat belt buckles are not in use for months but nevertheless have to permit, of course, insertion of the plug-in latch and safe locking thereof upon the first use.

It is the object of the invention to provide a seat belt buckle which excels by being extremely robust.

SUMMARY OF THE INVENTION

According to the invention, this object is achieved by a generic seat belt buckle in which a sealing device is provided which seals the inserting opening when the plug-in latch is not inserted and/or the release opening. In this way foreign matter is prevented from penetrating the interior of the belt buckle. The sealing device is designed especially to prevent liquids from penetrating the casing through the release opening or the inserting opening. Thus sugary beverages or food residues, for instance, are prevented or impeded from penetrating and consequently cannot lead to increased adhesion to components or gluing of the release button.

A compact design of the belt buckle is permitted, for instance, when the release opening and the inserting opening are merged and constitute a joint opening of the casing.

The sealing device can have a casing projection facing inwardly in the direction of the release opening and forming the edge of the release opening, wherein in its home position the release element is adjacent to the casing projection and is preferably forced against the casing projection. Such sealing device can be manufactured in a compact and inexpensive manner.

So as to permit an improved function of the sealing device an elastic seal can be provided at the casing projection and/or at the release element.

The elastic seal is connected, for instance, integrally with the casing and/or the release element. It is preferably manufactured by two-component injection molding. This facilitates the assembly of the belt buckle and prevents the elastic seal from detaching from the casing, for instance.

For an improved sealing of the inserting opening the sealing device may include a flap for closing and sealing the inserting opening.

Preferably the flap is formed such that upon inserting the plug-in latch into the inserting opening the flap releases the latter. This enables the vehicle occupant to easily operate the belt buckle.

It is possible that the flap is adjacent to a contact surface at the casing and/or at the release element and is preferably loaded by a spring against the casing or the release element.

For an enhanced sealing function an elastic seal can be provided at the flap and/or at the casing.

In order to permit easy assembly the elastic seal can be connected integrally with the flap and/or the casing and can preferably be manufactured by two-component extrusion molding.

In order to prevent small particles from penetrating the belt buckle even when the plug-in latch is inserted, the sealing device can be appropriately designed such that the inserting opening is sealed when the plug-in latch is inserted. Preferably the sealing device is suited to prevent liquids from penetrating the casing through the inserting opening.

DESCRIPTION OF THE EXAMPLE EMBODIMENT

Figure 1:
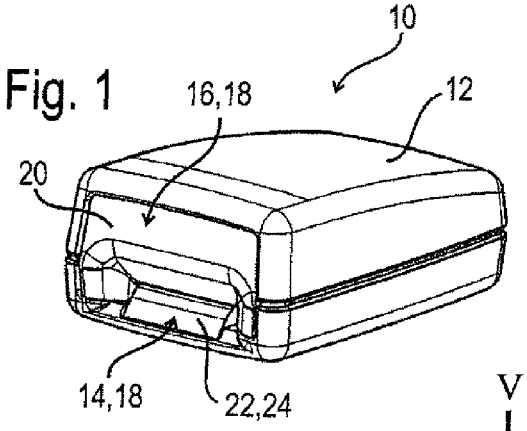
FIG. 1 shows a belt buckle according to the invention in a perspective view.

FIG. 1 illustrates a belt buckle 10 comprising a casing 12 that encloses a locking mechanism for a plug-in latch. The casing 12 includes an inserting opening 14 for inserting the plug-in latch as well as a release opening 16 which are merged and form a joint opening 18 of the casing 12. In the release opening 16 a release element 20 for releasing the locking mechanism is disposed. The locking mechanism of the belt buckle 10 is released by pressing the release element 20 and the plug-in latch is released.

Figure 2:
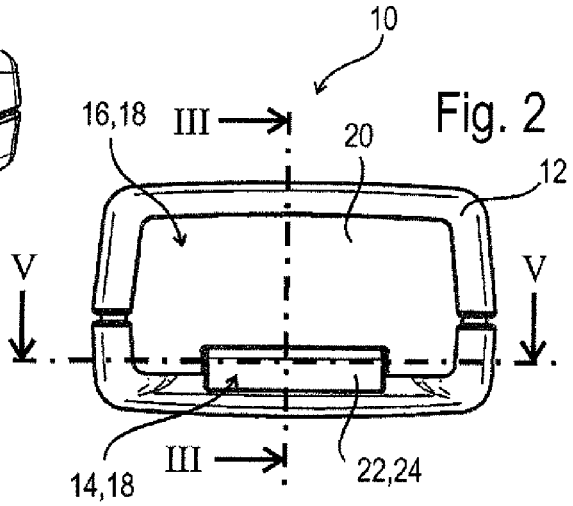
FIG. 2 is a top view onto the casing of the belt buckle according to FIG. 1 having a joint release and inserting opening.

FIG. 2 shows a top view onto the belt buckle 10 including the joint opening 18 and the release element 20 disposed therein. In the shown embodiment, the plug-in opening 14 is restricted, on the one hand, by the casing 12 and, on the other hand, by the release element 20.

Alternatively, it is also possible that the inserting opening 14 and the release opening 16 are provided in the form of separate openings in the casing 12 of the belt buckle 10.

A sealing device 22 is provided for sealing the release opening 16 and the inserting opening 14 when the plug-in latch is not inserted. The sealing device 22 comprises a flap 24 biased, for instance, in the direction of the closed position which closes and seals the inserting opening 14.

Figure 3:
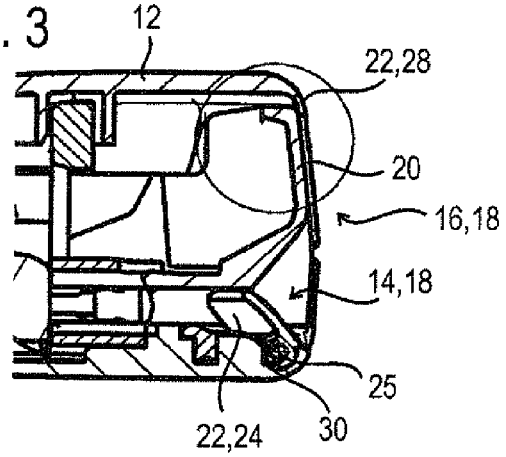
FIG. 3 is a sectional view across the belt buckle according to the sectional plane III-III of FIG. 2.
Figure 4:
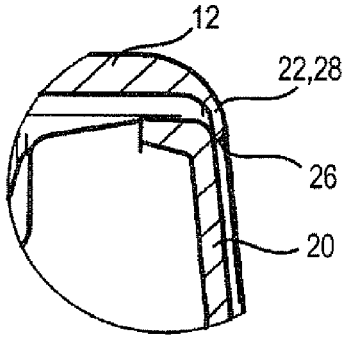
FIG. 4 shows an enlarged detailed view of the portion encircled in FIG. 3.

FIG. 3 shows a sectional view along the sectional plane in FIG. 2. The casing 12 includes a casing projection 28 facing inwardly in the direction of the release opening 16 and forming the edge of the release opening 16, wherein in its home position the end face of the release element 20 is adjacent to the casing projection 28, as is easily visible from the detailed view of FIG. 4. The casing projection 28 permits a very compact design of the sealing device 22 for sealing the release opening 16.

In its home position the release element 20 is forced against the casing projection 28 by the locking mechanism, whereby good sealing is obtained between the release element 20 and the casing projection 28.

FIG. 3 furthermore illustrates a sectional view of the flap 24 of the sealing device 22 which closes and seals the inserting opening 14 for the plug-in latch. The flap 24 is supported rotatably about an axis of rotation 25 in the casing 12 of the belt buckle 10. In its sealing position the flap 24 is adjacent to a contact face at the release element 20. A spring 30 loads the flap 24 against the contact face of the release element 20.

If the vehicle occupant inserts the plug-in latch into the belt buckle 10 for fastening the seat belt, the plug-in latch presses against the flap 24 and the flap 24 is pivoted about the axis of rotation 25 so as to release the inserting opening 14. In this way the vehicle occupant can insert the plug-in latch into the inserting opening 14 of the belt buckle 10 in a simple and conventional manner and especially requires no separate step for opening the inserting opening 14.

When the plug-in latch is inserted, the flap 24 is loaded by the spring 30 against the plug-in latch and seals the inserting opening 14 even when the plug-in latch is inserted.

Figure 5:
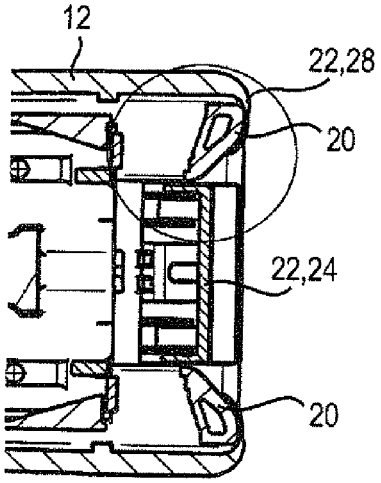
FIG. 5 shows a sectional view of the belt buckle according to FIG. 2 along the sectional plane V-V.
Figure 6:
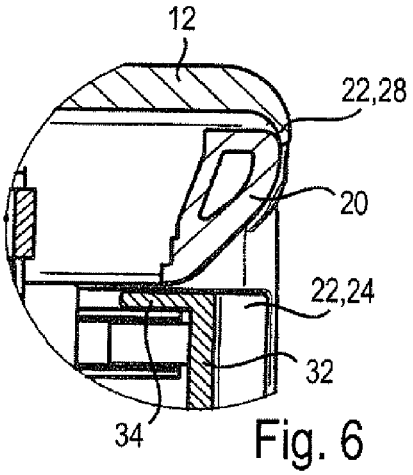
FIG. 6 is an enlarged detailed view of the portion encircled in FIG. 5.

FIG. 5 shows a sectional view of the belt buckle 10 along the sectional plane V-V. The release element 20 extends in the sectional plane on both sides of the inserting opening 14. As is clearly evident from the detailed view in FIG. 6, the release element 20 is adjacent to the casing projection 28 of the casing 12.

The flap 24 has an end wall 32 which substantially closes the inserting opening 14 as well as two side walls 34 by which the flap 24 is adjacent to the release element 20.

In the shown embodiment the flap 24 is supported on the casing 12 and is adjacent to the release element 20 in a tight-fitting manner. It is also possible that the flap 24 is attached to the release element 20 and is in sealing contact with the casing 12.

In order to permit optimum sealing the casing projection 28 is in the form of an elastic seal which is integrally connected to the casing 12. Another elastic seal which is integrally connected to the flap 24 is provided at the flap 24. The casing 12 including the elastic casing projection 28 and the flap 24 having the elastic seal are manufactured by two-component extrusion molding.

It is alternatively possible that the casing 12, the release unit 20 and the flap 24 are made of substantially non-elastic materials and are merely loaded to contact each other.

The flap 24 and/or other components of the seat belt buckle or the casing visible through the inserting opening 14, especially rattle-prevention elements or guide elements, can consist of fluorescent material or can be illuminated by a light source for better visibility in the dark. It is especially easily possible to design such elements of fluorescent material when said components are separate components which are connected to the casing.

The invention claimed is:

1. A seat belt buckle (10) comprising a locking mechanism for a plug-in latch and a casing (12) that encloses the locking mechanism and includes an inserting opening (14) for inserting the plug-in latch as well as a release opening (16) in which a release element (20) for releasing the locking mechanism is disposed, wherein a sealing device (22) is provided which seals the inserting opening (14) and/or the release opening (16) when the plug-in latch is not inserted, the sealing device engaging the release element.

2. The seat belt buckle (10) according to claim 1, wherein the release opening (16) and the inserting opening (14) are merged and form a joint opening (18) of the casing (12).

3. The seat belt buckle (10) according to claim 1, wherein the sealing device (22) has a flap (24) that is adapted to close and seal the inserting opening (14).

4. The seat belt buckle (10) according to claim 3, wherein the flap (24) is formed so that the flap (24) releases the inserting opening (14) upon inserting the plug-in latch into the inserting opening (14).

5. The seat belt buckle (10) according to claim 3, wherein the flap (24) is adjacent to a contact face at the casing (12) and/or at the release element (20) and is preferably loaded against the casing (12) or the release element (20), resp., by a spring (30).

6. The seat belt buckle (10) according to claim 3, wherein an elastic seal is provided at the flap (24) and/or at the casing (12).

7. The seat belt buckle (10) according to claim 6, wherein the elastic seal is integrally connected to the flap (24) and/or the casing (12) and is preferably manufactured by two-component injection molding.

8. The seat belt buckle (10) according to claim 1, wherein the sealing device (22) is designed so as to seal the inserting opening (14) when the plug-in latch is inserted.

9. A seat belt buckle (10) comprising a locking mechanism for a plug-in latch and a casing (12) that encloses the locking mechanism and includes an inserting opening (14) for inserting the plug-in latch as well as a release opening (16) in which a release element (20) for releasing the locking mechanism is disposed, wherein a sealing device (22) is provided which seals the inserting opening (14) and/or the release opening (16) when the plug-in latch is not inserted, and wherein the sealing device (22) includes a casing projection (28) facing inwardly in the direction of the release opening (16) and forming an edge (26) of the release opening (16), the release element (20) being adjacent to the casing projection (28) when in a home position.

10. The seat belt buckle (10) according to claim 9, wherein the release element (20) is loaded against the casing projection (28) when in the home position.

11. The seat belt buckle (10) according to claim 9, wherein an elastic seal is provided at the casing projection (28) and/or at the release element (20).

12. The seat belt buckle (10) according to claim 11, wherein the elastic seal is integrally connected to the casing (12) and/or the release element (20).

13. The seat belt buckle (10) according to claim 11, wherein the elastic seal and the casing and/or the release element are manufactured by two-component extrusion molding.

* * * * *